US009803850B2

(12) United States Patent
Nanni

(10) Patent No.: US 9,803,850 B2
(45) Date of Patent: Oct. 31, 2017

(54) LED LIGHTING SYSTEM

(71) Applicant: VIABIZZUNO S.r.l., Bentivoglio (IT)

(72) Inventor: Mario Nanni, Bologna (IT)

(73) Assignee: VIABIZZUNO S.R.L., Bentivoglio (Bologna) (IT)

( * ) Notice: Subject to any disclaimer, the term of this patent is extended or adjusted under 35 U.S.C. 154(b) by 0 days.

(21) Appl. No.: 15/119,189

(22) PCT Filed: Dec. 19, 2014

(86) PCT No.: PCT/IB2014/067121
§ 371 (c)(1),
(2) Date: Aug. 16, 2016

(87) PCT Pub. No.: WO2015/150888
PCT Pub. Date: Oct. 8, 2015

(65) Prior Publication Data

US 2017/0009977 A1 Jan. 12, 2017

(30) Foreign Application Priority Data

Apr. 1, 2014 (IT) ..... B02014A0184

(51) Int. Cl.
*F21V 1/00* (2006.01)
*F21V 29/83* (2015.01)
(Continued)

(52) U.S. Cl.
CPC ..... *F21V 29/83* (2015.01); *F21K 9/23* (2016.08); *F21V 3/0427* (2013.01);
(Continued)

(58) Field of Classification Search
CPC ..... F21V 29/70; F21V 29/83; F21V 29/004; F21V 9/23; F21V 3/0427; F21V 17/002;
(Continued)

(56) References Cited

U.S. PATENT DOCUMENTS 9,212,791 B2 12/2015 Kim et al.
2012/0032574 A1 2/2012 Lin et al.
(Continued)

FOREIGN PATENT DOCUMENTS

EP 2282109 A2 2/2011
EP 2565534 A1 3/2013
(Continued)

OTHER PUBLICATIONS

International Search Report and Written Opinion dated Apr. 2, 2015 from counterpart PCT App No. PCT/IB2014/067121.

*Primary Examiner* — Laura Gudorf
(74) *Attorney, Agent, or Firm* — Shuttleworth & Ingersoll, PLC; Timothy J. Klima

(57) ABSTRACT

An LED lighting system including a base stably connectable to a structure of a lamp, a supporting body for at least one LED, means for removably connecting said supporting body to said base, means for electrically connecting the base and the supporting body, the connecting means including a male connector and a female connector, heat dissipating means for dissipating the heat generated while said at least one LED is ON.

8 Claims, 3 Drawing Sheets

(51) Int. Cl.

| | |
|---|---|
| ***F21V 29/00*** | (2015.01) |
| ***F21V 17/00*** | (2006.01) |
| ***F21V 19/04*** | (2006.01) |
| ***F21V 29/70*** | (2015.01) |
| ***F21K 9/23*** | (2016.01) |
| ***F21V 3/04*** | (2006.01) |
| ***F21V 17/12*** | (2006.01) |
| ***F21V 23/00*** | (2015.01) |
| ***F21V 23/06*** | (2006.01) |
| *F21Y 115/10* | (2016.01) |

(52) U.S. Cl.
CPC ..... *F21V 17/002* (2013.01); *F21V 17/12* (2013.01); *F21V 19/045* (2013.01); *F21V 23/003* (2013.01); *F21V 23/005* (2013.01); *F21V 23/06* (2013.01); *F21V 29/004* (2013.01); *F21V 29/70* (2015.01); *F21Y 2115/10* (2016.08)

(58) Field of Classification Search
CPC ..... F21V 17/12; F21V 23/003; F21V 23/005; F21V 23/06; F21V 2115/10
See application file for complete search history.

(56) References Cited

U.S. PATENT DOCUMENTS

| | | | | |
|---|---|---|---|---|
| 2012/0293652 | A1 | 11/2012 | Farmer | |
| 2013/0063945 | A1 | 3/2013 | Wu et al. | |
| 2015/0192284 | A1* | 7/2015 | Steinberg | F21V 23/06 362/231 |

FOREIGN PATENT DOCUMENTS

| | | | |
|---|---|---|---|
| JP | 2010061852 | A | 3/2010 |
| WO | WO2013151219 | A1 | 10/2013 |

* cited by examiner

LED LIGHTING SYSTEM

This application is the National Phase of International Application PCT/IB2014/067121 filed Dec. 19, 2014 which designated the U.S. and that International Application was published under PCT Article 21(2) in English.

This application claims priority to Italian Patent Application No. BO2014A000184 filed Apr. 1, 2014, which application is incorporated by reference herein.

TECHNICAL FIELD

This invention relates to a lighting system.

More specifically, this invention relates to a lighting system which uses light emitting diodes (LEDs).

BACKGROUND ART

Over recent years, the use of LEDs in lighting systems has become increasingly widespread thanks to their numerous advantages over traditional incandescent, neon and halogen lamps.

Although the average price of LED light bulbs is higher than that of traditional light bulbs, their average life is decidedly longer, easily exceeding 50,000 hours.

Further, unlike incandescent light bulbs, which stop working all of a sudden when the filament breaks, the working life of an LED ends gradually, with appreciable but not excessive loss of light intensity, making it possible to plan substitution without running the risk of sudden complete loss of light.

The apparently inexorable spread of LED light bulbs is, however, almost certainly due to their energy efficiency: in effect, they are much more efficient than filament (or even halogen) light bulbs since much less energy is wasted in the form of infrared radiation and heat released to the environment compared to traditional light bulbs.

Manufacturers of light bulbs have therefore started producing LED light bulbs with standard connectors, making them suitable for installation in place of traditional light bulbs.

Owing to the constant growth of LED technology, however, industrial production is unable to keep up with new developments, not only on account of the investments required but also on account of the minimum required time for putting a new product into production.

In effect, the creation of new and increasingly higher performing LEDs renders the LED light bulbs present on the market rapidly obsolete.

Further, in terms of operating versatility, the LED bulbs currently available on the market do not allow easy management in electronic terms because they have only two electrodes corresponding to the positive and negative poles.

A further drawback of LED bulbs currently available on the market is due to their physical limitations to the capacity to dissipate heat. In effect, since LED bulbs are normally designed for medium wattage lighting, high wattage LEDs such as would, for example, be needed to light shop windows, cannot be mounted in such light bulbs because they would not be able to dissipate the heat they produce.

The above mentioned drawbacks in turn lead to a strongly felt problem in the field of lamp design, precisely because of the difficulty of predicting technical developments (not only in functional terms but also, and above all, in dimensional terms) of potentially usable LED bulbs. In other words, when designing a lamp or luminaire, it is extremely difficult, for example, to predict the size of a better performing or more powerful LED bulb which might appear on the market as little as one year after the lamp or luminaire has been put into production.

Aim of the Invention

The aim of this invention is to provide an LED lighting system capable of overcoming the drawbacks of the prior art and which is at once practical to use and simple to make.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a non-limiting embodiment of the invention by way of an example, and in which:

DETAILED DESCRIPTION OF PREFERRED EMBODIMENTS OF THE INVENTION

Figure 1:
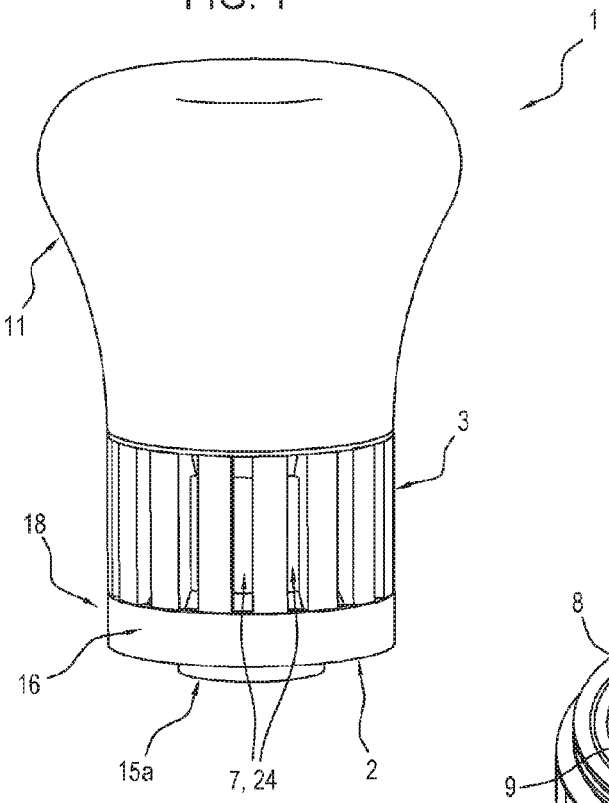
FIG. 1 shows a preferred embodiment of the LED lighting system according to this invention in a schematic perspective view.

As illustrated in FIG. 1, the numeral 1 denotes in its entirety an LED lighting system made according to this invention.

The system 1 according to the invention is intended to be integrated in lamps, not illustrated, equipped with a structure capable of supporting the system.

By way of non-limiting example, a lamp not illustrated adapted to integrate the system 1 illustrated in the accompanying drawings comprises a base and at least one rod for supporting the system 1.

With reference to FIG. 1, the LED lighting system according to the invention comprises a base 2 stably connectable to a structure, not illustrated, of a lamp, also not illustrated.

The system 1 further comprises a supporting body 3 for at least one LED 4.

The LED 4 is advantageously of the type mounted on a plate or board, better known as SMD, the abbreviation for surface-mount device.

Figure 5:
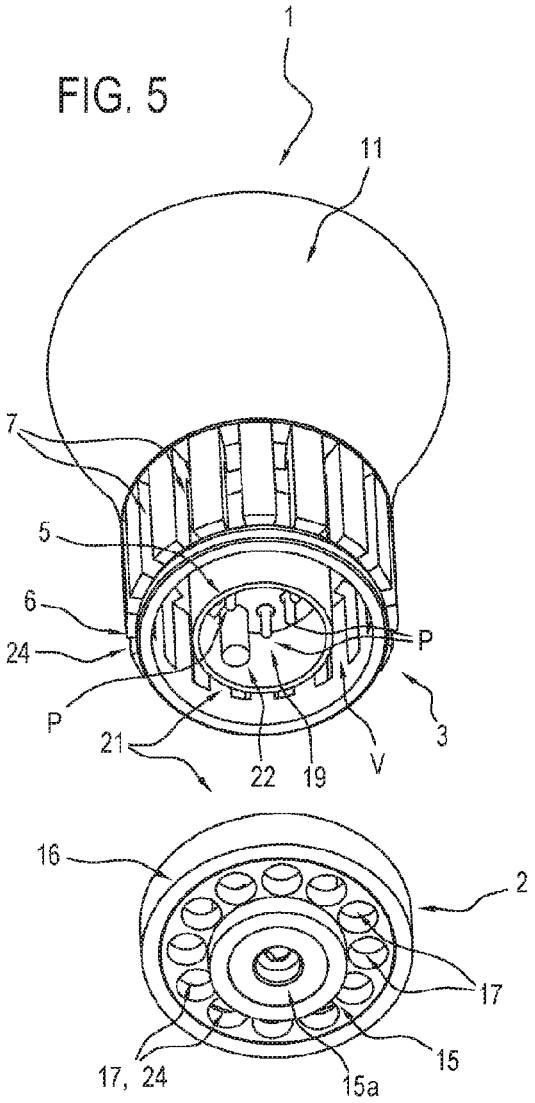

As illustrated in the accompanying drawings, in particular FIG. 5, the supporting body 3 is axisymmetric and has an inner cylindrical wall 5 and an outer cylindrical wall 6 which are coaxial with each other with reference to a common central axis C of the body 3 itself.

Between the two inner and outer cylindrical walls 5, 6 there is an empty annular space V which defines a gap having the shape of a cylindrical crown.

The outer cylindrical wall 6 has a plurality of first openings 7 extending longitudinally parallel to the axis C.

The first openings 7 are designed to place the annular space V in communication with the outside environment to allow air to flow between the annular space and the outside environment.

Figure 6:
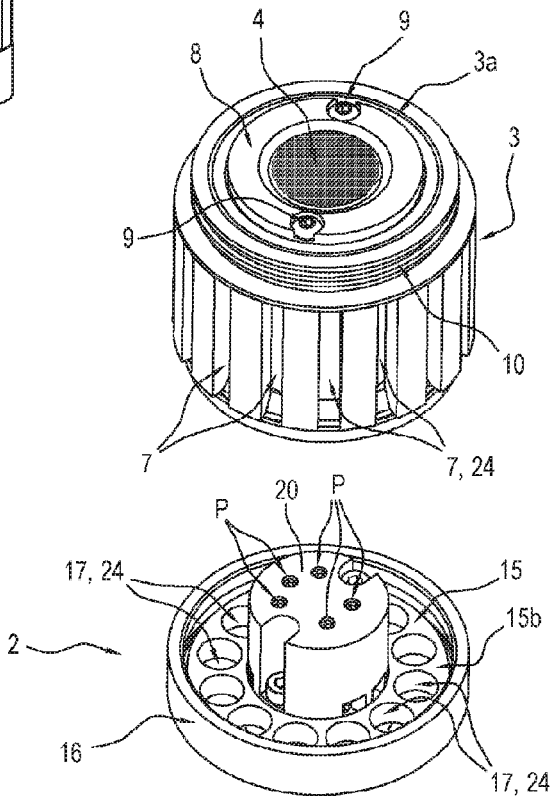
FIG. 6 is a schematic perspective view from above, with some parts cut away in order to better illustrate others, of the lighting system of the preceding figures.

With reference to FIG. 6, the LED 4 is mounted on a top face 3*a* of the supporting body 3 and is secured thereto by means of a retaining ring 8.

The retaining ring 8 is removably connected to the supporting body 3 by two screws 9.

In alternative embodiments not illustrated the retaining ring 8 is removably connected to the supporting body 3 by slotted joints.

Between the LED 4 and the top face 3*a* of the supporting body 3 there is a layer, not illustrated, of thermal paste to facilitate dissipation by conduction to the supporting body 3 of the heat generated by the LED 4.

Figure 3:
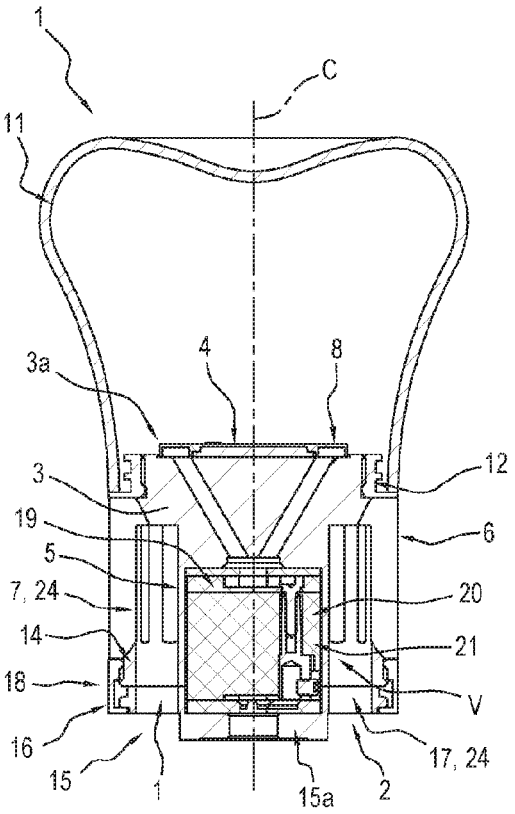
FIG. 3 is a cross section view through the line III-III of FIG. 2.

As illustrated in FIGS. 3 and 6, the supporting body 3 has, on the outer cylindrical wall 6, a circular, threaded upper rim 10.

The system 1 also comprises a diffuser element 11 for the light emitted by the LED 4.

The diffuser element 11 is advantageously, but not necessarily, made of glass.

As illustrated in FIG. 3, the diffuser element 11 comprises a threaded ring 12 located at an end portion of it.

The threaded ring 12, together with the threaded upper rim 10 defines, for the system 1, screwing connection means 13 for removably connecting the diffuser 11 and the supporting body 3.

As illustrated in FIGS. 3 and 5, the supporting body 3 has, on the outer cylindrical wall 6, a circular, threaded lower rim 14.

With reference in particular to FIGS. 5 and 6, the base 2 is axisymmetric and comprises a circular portion 15 and a threaded ring 16 which is rotatably connected to the circular portion 15.

The circular portion 15 has a central part 15*a* designed to engage the above mentioned and not illustrated structure of a lamp, advantageously, but not necessarily, by screwing.

The circular portion 15 also has an outer annular part 15*b* having a plurality of second openings 17 which are angularly spaced along its circumference.

Figure 2:
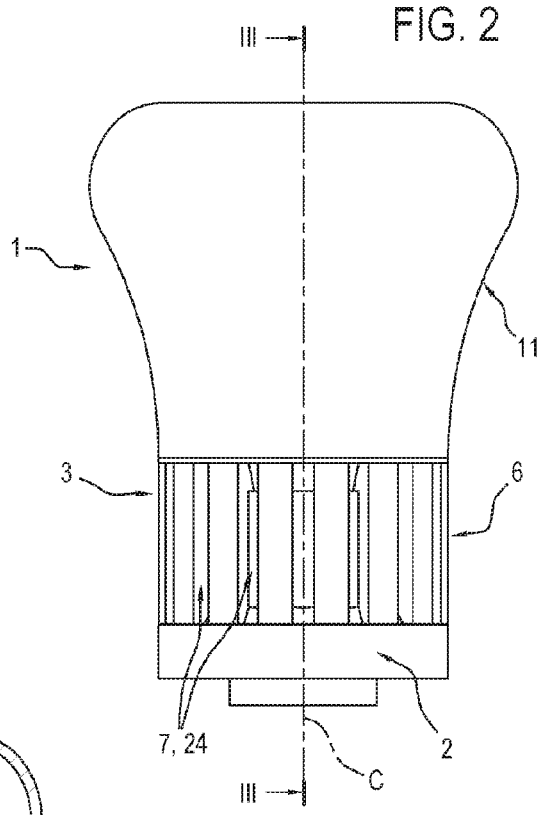
FIG. 2 shows the lighting system of FIG. 1 in a schematic elevation view.

As clearly illustrated in FIGS. 1 to 3, the threaded ring 16 of the base 2 is designed to screwably engage the threaded lower rim 14 of the supporting body 3.

The threaded ring 16 and the threaded lower rim 14 thus define, for the system 1, means 18 for removably connecting the base 2 and the supporting body 3.

Figure 4:
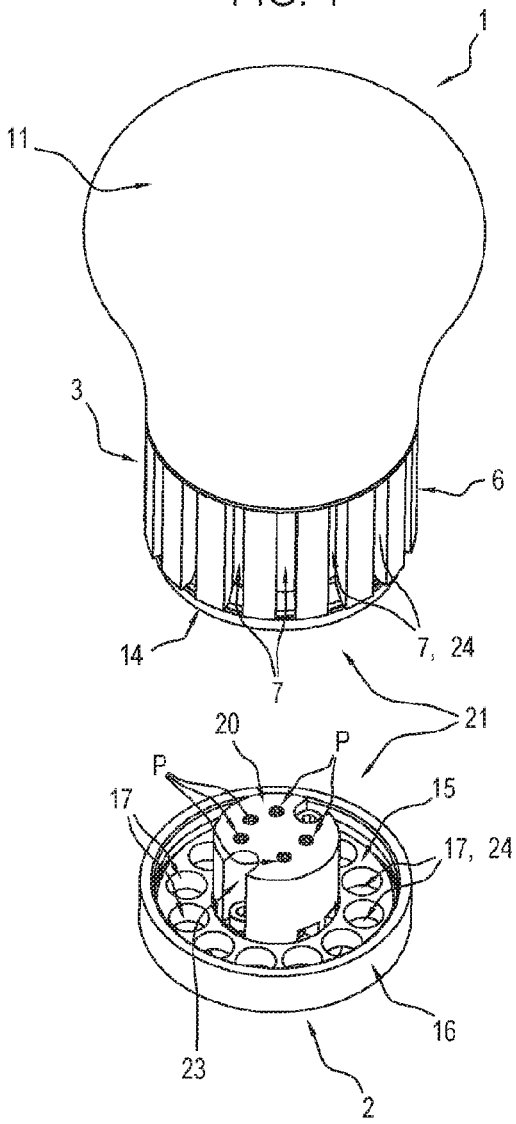
FIGS. 4 and 5 show the lighting system of the preceding figures, partly disassembled, in respective schematic perspective views from above and from below.

As illustrated in FIGS. 3, 4 and 5, a male electrical connector 19 is mounted inside the supporting body 3 and a female electrical connector 20 is fixed to the circular portion 15 of the base 2.

The male and female electrical connectors 19, 20 define for the system 1 means 21 for electrically connecting the base 2 and the supporting body 3.

As clearly shown in FIG. 3, the inner cylindrical wall 5 defines an element for containing the electrical connection means 21.

When the supporting body 3 and the base 2 are assembled to each other, the inner cylindrical wall 5, in defining an element for containing the connection means 21, also constitutes a protection for the means 21.

Advantageously, in the preferred but not exclusive embodiment illustrated in the accompanying drawings, the male and female electrical connectors 19, 20 comprise a plurality of poles. More specifically, there are five poles illustrated in the drawings, all denoted by the reference character P.

The poles P are defined, on the male connector 19, by a plurality of protruding pins and, on the female connector 20, by corresponding sockets for receiving the pins.

The presence of more than two poles P allows providing not only the electrical power supply for the LED 4 but also an electronic control feature for the LED 4.

Advantageously, for this purpose, the system 1 according to the invention comprises a control circuit connected to the poles P, this control circuit being configured to control the LED 4 according to a digital control protocol.

Advantageously, the above mentioned and not illustrated control circuit is at least partly housed in the base 2, within the cylindrical space defined by the female connector 20.

The most widely used digital control protocols are known as DALI (digital addressable lighting interface) and DMX (digital multiplex signal).

With reference to FIGS. 4 and 5, the male connector 19 comprises a reference pin 22 protruding parallel to, and further out than, the pins defining the poles P, in an eccentric position, whilst the female connector 20 comprises a socket 23 for receiving the pin 22. The reference pin 22 and the related socket 23 define, for the system 1, means for quickly and firmly positioning the two electrical, male and female connectors 19, 20 relative to each other.

As illustrated in the accompanying drawings, the aforementioned first openings 7 made in the outer cylindrical wall 6, together with the aforementioned second openings 17 made in the annular part 15*b* of the circular portion 15 of the base 2, define for the system 1 heat dissipating means 24 for dissipating the heat generated while the LED 4 is ON, meaning by the term ON the maintaining of the LED in the lit condition.

Looking in more detail, in the assembled condition, illustrated in particular in FIG. 3, where the circular portion 15 of the base 2 is positioned coaxially with the inner cylindrical wall 5 of the supporting body 3, the second openings 17 made in the circular portion 15 open into the aforementioned annular space V and form respective channels for the circulation of an air flow for cooling the supporting body 3.

In other words, the second openings 17, which, in the example illustrated in the accompanying drawings, consist of respective circular holes, define an equal number of ducts inside which convective motion is produced by which cool air is sucked into the annular space V through the second openings 17 themselves, while a corresponding flow of hot air is expelled through the first openings 7.

Clearly, the flow just described refers to the arrangement of the system 1 as illustrated in the accompanying drawings.

In other terms, thanks to the air circulation channels defined by the first and second openings 7, 17 made in the supporting body 3 and base 2, respectively, the cooling capacity of the system 1 is considerably improved.

In effect, a convective motion is produced which sucks cool air in from below through the second openings 17, heats this air upon contact with the cylindrical walls 5, 6 of the supporting body 3 and expels it through the first openings 7, thereby preventing hot air from remaining in the proximity of the LED 4 and making more effective the heat exchange and thus, the cooling of the system 1 as a whole.

A different arrangement, for example where the base 2 is directed upwards (as in the case of a lamp hanging from a ceiling) will produce a convective flow identical to the one just described, but in opposite direction, such that cool air is sucked into the annular space V through the first openings 7 while a corresponding flow of hot air is expelled to the outside environment through the second openings 17 made in the circular portion 15 of the base 2.

This invention also relates to an effective method for substituting an LED 4 in a lighting system 1 as described above.

The method comprises a step of freeing the supporting body 3 from the respective base 2 by operating on the removable connecting means 18, that is to say, by unscrewing the threaded ring 16.

This is followed by a step of removing the LED 4 from the supporting body 3, in this specific case, by undoing the screws 9 and lifting the retaining ring 8.

A further step of the method entails positioning a new LED 4 on the supporting body 3 and making the necessary electrical connections.

Lastly, the method according to the invention comprises a step of engaging the supporting body 3 on the respective base 2 again, using the connecting means 18, that is to say, by tightening the threaded ring 16.

The invention offers considerable advantages.

A first advantage connected with the use of the LED lighting system according to the invention is the possibility of changing the LED 4 extremely easily, thus making it possible to have lamps and lighting systems whose functionality is optimized relative to the lighting technology currently available.

This possibility is particularly welcome in the context of shops, where it is very important to be able to use cutting-edge and high-level technology, for display window lighting, for example.

Another advantage offered by the invention is the fact that effective cooling of the LED 4, even in the case of high wattage lighting, is guaranteed by the distinctive structure and arrangement of the dissipating means 24.

Yet another advantage is that lighting designers who adopt the lighting system 1 according to the invention in their creations can put off the choice of light bulb to any later stage, since the supporting body 3 can be fitted with a wide variety of different LEDs 4. In other words, adopting the lighting system 1 according to the invention does not place constraints on designers, as does the use of traditional light bulbs, when creating a new lamp.

The invention as described and illustrated thus achieves the set aims.

The invention claimed is:

1. A light emitting diode (LED) lighting system, comprising:

a base stably connectable to a structure of a lamp, at least one LED, a supporting body for the at least one LED, a connector for removably connecting said supporting body to said base, an electrical connector for electrically connecting said base and said supporting body, said electrical connector comprising a male connector and a female connector, said male connector being fixed on one of either said base or said supporting body, and said female connector being fixed on the other of either said base or said supporting body, a heat dissipater for dissipating the heat generated while said at least one LED is ON;

wherein the supporting body comprises an inner cylindrical wall for containment of said electrical connector, and an outer wall; the inner cylindrical wall and outer wall forming an empty annular space therebetween, wherein the heat dissipater comprises a plurality of first openings made in said outer wall for allowing an air flow between the annular space and an outside environment;

where the base comprises a circular portion positioned coaxially with the inner cylindrical wall, wherein the heat dissipater comprises a plurality of second openings in the circular portion and opening into the annular space for forming respective channels for the circulation of the air flow for cooling the supporting body.

2. The lighting system according to claim 1, and further comprising a diffuser element for the light emitted by said LED, said diffuser element being removably connected to said supporting body.

3. The lighting system according to claim 2, and further comprising a threaded connection connecting said diffuser element and said supporting body, the threaded connection comprising a threaded ring located on said diffuser element.

4. The lighting system according to claim 1, wherein said male and female connectors comprise a plurality of poles.

5. The lighting system according to claim 4, wherein said male and female connectors comprise at least three poles.

6. The lighting system according to claim 5, and further comprising a control circuit and in that said at least three poles are connected to said control circuit, said control circuit for controlling the LED according to a digital control protocol.

7. The lighting system according to claim 6, wherein said control circuit is at least partly housed in the base.

8. A method for substituting a light emitting diode (LED) in a lighting system, comprising:

providing:

a base stably connectable to a structure of a lamp, at least one LED, a supporting body for the at least one LED, a connector for removably connecting said supporting body to said base, an electrical connector for electrically connecting said base and said supporting body, said electrical connector comprising a male connector and a female connector, said male connector being fixed on one of either said base or said supporting body, and said female connector being fixed on the other of either said base or said supporting body, a heat dissipater for dissipating the heat generated while said at least one LED is ON;

wherein the supporting body comprises an inner cylindrical wall for containment of said electrical connector, and an outer wall; the inner cylindrical wall and outer wall forming an empty annular space therebetween, wherein the heat dissipater comprises a plurality of first openings made in said outer wall for allowing an air flow between the annular space and an outside environment;

where the base comprises a circular portion positioned coaxially with the inner cylindrical wall, wherein the heat dissipater comprises a plurality of second openings in the circular portion and opening into the annular space for forming respective channels for the circulation of the air flow for cooling the supporting body, freeing said supporting body from the base by operating on the connector, removing the LED from the supporting body, positioning a new LED on the supporting body and making necessary electrical connections, engaging said supporting body on the base again using the connector.

* * * * *